United States Patent [19]

Strahm et al.

[11] Patent Number: 4,908,918

[45] Date of Patent: Mar. 20, 1990

[54] METHOD AND APPARATUS FOR COMPRESSIVE SHRINKAGE OF TUBULAR FABRIC

[75] Inventors: Christian Strahm, Bronschhofen; Paul Suess, Bettwiesen, both of Switzerland

[73] Assignee: Santex AG, Tobel, Switzerland

[21] Appl. No.: 207,760

[22] Filed: Jun. 16, 1988

[30] Foreign Application Priority Data

Jun. 16, 1987 [EP] European Pat. Off. ..... 87810343.1

[51] Int. Cl.[4] ..... D06C 21/00

[52] U.S. Cl. ..... 26/18.6

[58] Field of Search ..... 26/18.6, 80, 81

[56] References Cited

U.S. PATENT DOCUMENTS

| | | | |
|---|---|---|---|
| 1,971,211 | 8/1934 | Cluett | 26/18.6 |
| 2,209,205 | 7/1940 | Neville | 26/18.6 X |
| 2,374,482 | 4/1945 | Hadfield et al. | 26/18.6 |
| 3,940,833 | 3/1976 | Troope et al. | 26/18.6 |
| 4,247,969 | 2/1981 | Diggle, Jr. et al. | 26/18.6 |
| 4,562,627 | 1/1986 | Milligan . | |
| 4,603,799 | 8/1986 | Schaerer . | |

FOREIGN PATENT DOCUMENTS

| | | | |
|---|---|---|---|
| 194050 | 3/1967 | U.S.S.R. | 26/81 |
| 542774 | 3/1977 | U.S.S.R. | 26/81 |
| 553316 | 6/1977 | U.S.S.R. | 26/81 |
| 739157 | 6/1980 | U.S.S.R. | 26/81 |

*Primary Examiner*—Werner H. Schroeder

*Attorney, Agent, or Firm*—Watts, Hoffmann, Fisher & Heinke Co.

[57] ABSTRACT

A method and apparatus for smoothing and shrinking tubular fabric material. The method comprises stretching the material along its width and moistening the stretched material. The material then enters a first smoothing and shrinking unit and is turned around a turning roller. The material engages a shrinkage belt which presses one side of the material against a support roller. The material then exits the first smoothing and shrinking unit and enters a second where the other side of the material is treated. The shrinkage of the material is increased since an elastic layer on each shrinkage belt varies the surface tension engaged to each side of the material.

28 Claims, 2 Drawing Sheets

METHOD AND APPARATUS FOR COMPRESSIVE SHRINKAGE OF TUBULAR FABRIC

BACKGROUND OF THE INVENTION

1. Field of the Invention

This invention relates to the smoothing and shrinking of fabrics and more particularly to the smoothing and shrinking of textile hose through the use of moisture and calendering.

2. Description of Related Art

It is already well known to smooth and shrink tubular mesh fabrics or hose by stretching the fabric along its width, moistening the stretched fabric with steam and pressing the fabric between a pair of rollers. This method has the significant disadvantage of reducing the shrink of the fabric due to the pressing between the rollers, however.

In another familiar method, the fabric is moistened and then conducted around a smoothing and compacting roller by means of a conveyor belt. This method has the disadvantage that the surface of the belt remains practically undeformed throughout the treatment of the fabric. Many hose materials cannot be shrunk sufficiently in this manner since the material remains practically immovable upon the conveyor belt surface.

SUMMARY OF THE INVENTION

The present invention provides a method and apparatus which significantly improve the shrink of the material being treated by varying the forces on the surface of the belt between initial and final engagement with the material.

In a preferred embodiment, the material is stretched along its width in a fabric spreader and moistened in a moistening unit. The material is then passed to a first smoothing and shrinking unit which comprises a first turning roller, a first support roller and a first shrinkage belt. The material engages the first shrinkage belt and is turned around the first turning roller. A first side of the material is then pressed against the first support roller by the first shrinkage belt.

The hose material then enters a second smoothing and shrinking unit which comprises a second turning roller, a second support roller and a second shrinkage belt. The material engages the second shrinkage belt and is turned around the second turning roller. The second side of the material is then pressed against the second support roller by the second shrinkage belt.

The shrinkage belts each comprise a substantially unstretchable base support layer overlaid with an elastic layer. The elastic layer provides a variable surface tension which improves the shrinkage of the material.

In another preferred embodiment of the invention, moisture is caused to permeate both the elastic layer and the base support layer of one or both of the shrinkage belts.

In another preferred embodiment, one or both of the shrinkage belts is moistened or dried.

In another preferred embodiment of the invention, the elastic layer of each of the shrinkage belt comprises felt or gauze. The thickness of each shrinkage belt is from 8 mm to 16 mm, preferably 12 mm or above.

In another preferred embodiment of the invention, the relative speed of one or both of the support rollers and the material is different than the relative speed of the shrinkage belt associated with that support roller and the material. This speed differential inhibits the appearance of gloss or shine on the material.

In another preferred embodiment, the material remains in engagement with one or both of the support rollers after the material has disengaged from the associated shrinkage belt.

In another preferred embodiment, the flexure of the material about one of the turning rollers concludes and the flexure about the associated support roller commences substantially in a line disposed in an imaginary plane located by the axes of the rollers, Since the elastic layer is stretched on the turning roller and relaxed on the support roller, the change in curvature increases the shrinkage effect of the belt.

In another preferred embodiment, the moistening unit induces a moisture content of 5% to 20% by weight, preferably 10% to 15%.

In another preferred embodiment, the first support roller is heated and the second support roller is cooled.

Additional features will become apparent and a fuller understanding obtained by reading the following detailed description made in connection with the accompanying drawings.

DESCRIPTION OF THE PREFERRED EMBODIMENT

Figure 1:
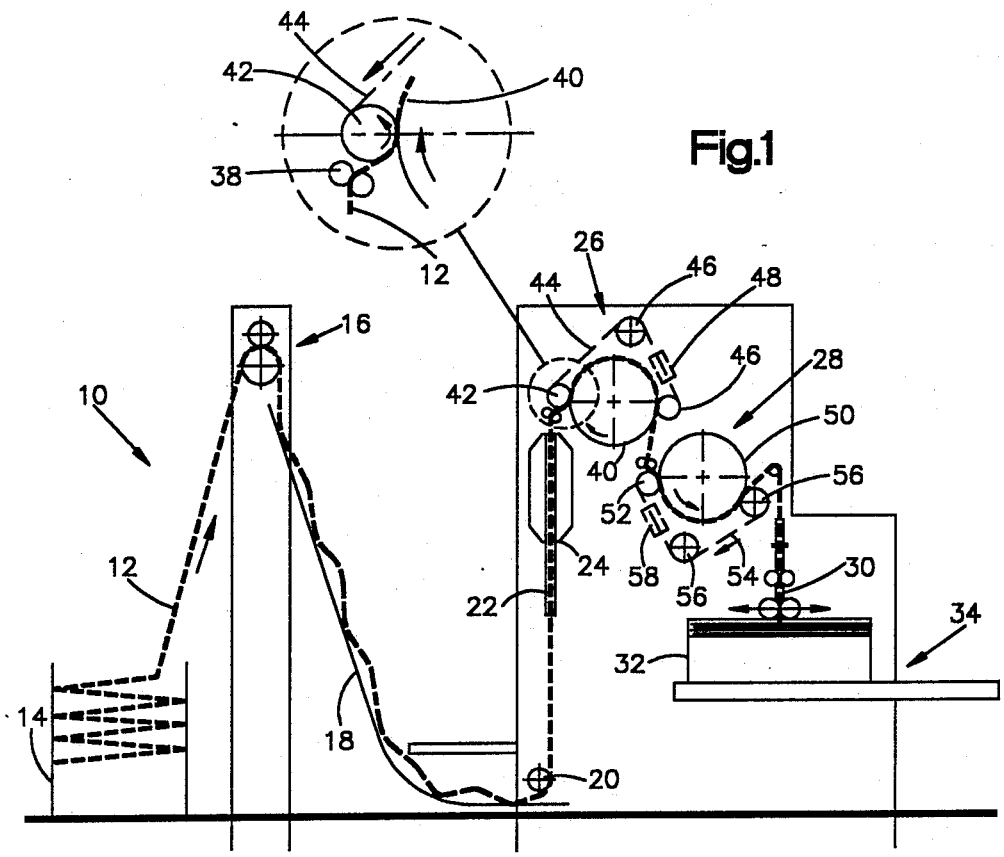
FIG. 1 is a schematic diagram of the smoothing and shrinking apparatus of the invention.

Referring now to the drawings and to FIG. 1 in particular, an apparatus embodying the present invention is shown generally at 10. Tubular fabric material 12 is drawn from a supply container 14 by a feeding mechanism 16. The material 12 is then fed down a slide 18, around a roller 20 and into a tubular fabric spreader 22.

The fabric spreader 22 stretches the material 12 along its width and feeds the material into the steaming box 24 which serves as a moistening unit. The steaming box 24 moistens the stretched material 12 intensively from both sides until the material has about 10% to 15% moisture by weight. (5% to 20% moisture by weight are acceptable.) The material 12 next passes to the smoothing and shrinking units 26, 28 which compress the material to complete the treatment. A precision plaiter 30 folds the treated material 12 onto a plaiting table 32 for removal through a fabric exit shown generally at 34.

Each of the smoothing and shrinking units 26, 28 comprises a support roller 40, 50, a turning roller 42, 52 and a shrinkage belt 44, 54. In each of the smoothing and shrinking units 26, 28, the shrinkage belt 44, 54 engages the turning roller 42, 52, the support roller 40, 50 and one or more other rollers 46, 56.

The material 12 is fed quickly from the steaming box 24 to the first smoothing and shrinking unit 26. In the embodiment shown in FIG. 1, the material 12 passes through a nip 38 and engages the first shrinkage belt 44 on the surface of the first turning roller 42. The material 12 and the first shrinkage belt 44 are turned around the first turning roller 42 and engage the first support roller 40. As the material 12 is driven over the first support roller 40, the first shrinkage belt 44 presses the material 12 against the support roller. The speed of the first support roller 40 is slightly less than that of the first shrinkage belt 44 to avoid creating a gloss on the material 12.

The material 12 passes from the first smoothing and shrinking unit 26 to the second smoothing and shrinking unit 28. The material 12 first passes through a nip (not shown) and engages the second shrinkage belt 54 on the surface of the turning roller 52. The second turning roller 52 turns the material 12 and the second shrinkage belt 54 before feeding both to the second support roller 50. The second shrinkage belt 54 presses the material 12 against the second support roller 50. The speed of the second support roller 50 is slightly less than that of the second shrinkage belt 54 to avoid creating a gloss on the material 12.

Since the direction of rotation of the second turning roller 52 is the same as that of the first support roller 40 and opposite that of the second support roller 50, the side of the material 12 treated in the second smoothing and shrinking unit 28 is opposite the side treated in the unit 26.

Figure 3:
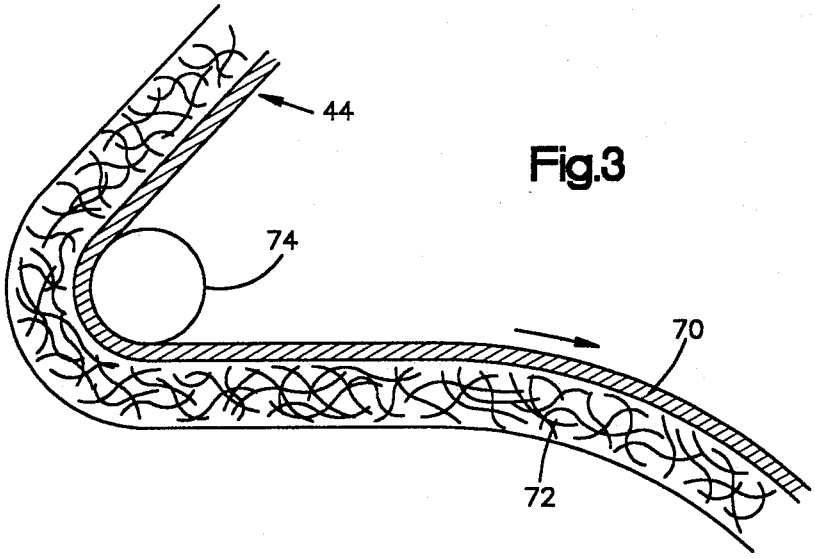
FIGS. 3 and 4 are schematic diagrams of a shrinkage belt turning on a roller.
Figure 4:
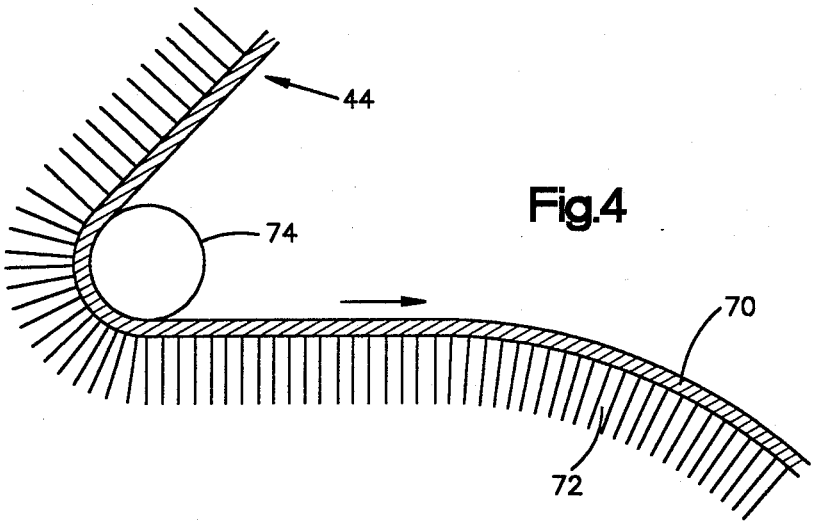

As shown in FIGS. 3 and 4, the shrinkage belt comprises a base support layer 70 and an elastic layer 72. The elastic layer 72 is composed of felt or gauze. The shrinkage belt should be 8 mm to 16 mm thick, preferably at least approximately 12 mm thick.

As best shown in FIG. 4, when a belt constructed according to the previous paragraph is used, the outer surface of the elastic layer 72 is stretched when the belt passes over a roller 74 and relaxed when the belt straightens. Thus, returning to FIG. 1, when the first shrinkage belt 44 is fitted over the first turning roller 42 so that the elastic layer 72 (not shown in FIG. 1) is to the outside, the outer surface of the elastic layer is stretched as it turns about the turning roller. Since the flexure of the material 12 and the first shrinkage belt 44 about the first turning roller 42 concludes and the flexure about the first support roller 40 commences on a line disposed in an imaginary plane 74 (FIG. 2) connecting the axes of the first rollers 40, 42, the elastic layer relaxes as the shrinkage belt 44 passes to the support roller. This effect provides a variable surface tension on the first shrinkage belt 44 which improves the shrink of the material 12.

A similar arrangement of the second support roller 50, the second turning roller 52 and the second shrinkage belt 54 likewise provides a variable surface tension on the second shrinkage belt which further increases the shrink of the material 12.

Both shrinkage belts 44, 54 are constructed of water permeable base support layers and elastic layers to improve performance. The performance for some fabrics may be improved by moistening or drying the shrinkage belts through a pair of belt moistening or drying units 48, 58.

The performance may also be improved by heating the first support roller 40 and heating or cooling the second support roller 50. In one embodiment, both support rollers 40, 50 are heated to a temperature of 80° C. to 160° C., preferably 100° C. to 120° C.

Figure 2:
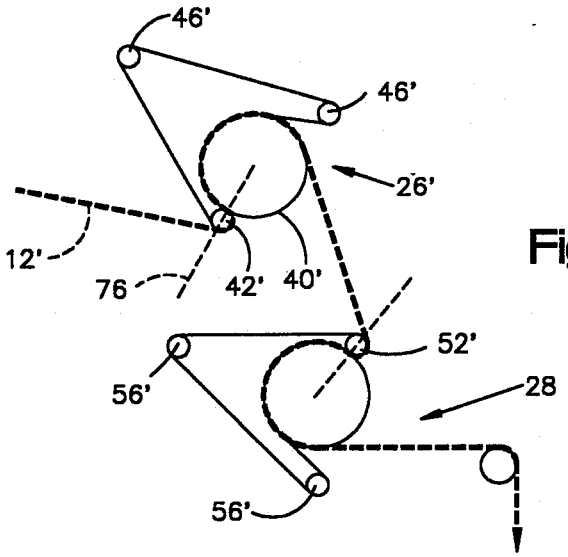
FIG. 2 is a schematic diagram of an alternative arrangement of the first and second smoothing and shrinking units.

An alternative arrangement for the smoothing and shrinking units is shown in FIG. 2. As with the arrangement of FIG. 1, the material enters each smoothing and shrinking unit 26', 28' though nips (not shown) and engages a shrinkage belt 44', 54' on the surface of a turning roller 42', 52'. The turning roller turns the material 12' and the shrinkage belt 44', 54' and passes both to the support roller 40', 50'. In this arrangement, the material 12' remains engaged with the support rollers 40, 50 after disengagement with the associated shrinkage belts 44, 54.

While preferred embodiments of this invention have been described in detail, it will be apparent that certain modifications or alterations can be made therein without departing from the spirit or scope of the invention set forth in the appended claims.

We claim:

1. A method for continuously moistening, smoothing and compressively shrinking tubular textile material comprising the steps of:

(a) stretching the material along its width;

(b) moistening the stretched material;

(c) turning a first shrinking belt having an elastic layer and an inelastic layer around a first turning roll so that the elastic side of the first shrinking belt faces radially outwardly away from a center of the first turning roll;

(d) engaging a first side of said material with the elastic layer of the first shrinking belt on the first turning roll;

(e) passing the material engaged with the elastic layer of the first shrinking belt over a first support roll;

(f) turning a second shrinking belt having an elastic layer and an inelastic layer around a second turning roll so that the elastic side of the second shrinking belt faces radially outwardly away from a center of the second turning roll;

(g) engaging a second side of said material with the elastic layer of the second shrinking belt on the second turning roll; and (h) passing the material engaged with the elastic layer of the first shrinking belt over a first support roll.

2. The method of claim 1 wherein the elastic layer of at least one of the shrinkage belts is held in engagement with the material by a substantially unstretchable base support layer.

3. A method according to claim 2 wherein moisture is caused to permeate both said elastic layer and said base support material in at least one of said shrinkage belts.

4. A method according to claim 1 wherein the material remains in engagement with said first support roller after the material has disengaged from said first shrinkage belt.

5. A method according to claim 1 wherein the material remains in engagement with said second support roller after the material has disengaged from said second shrinkage belt.

6. A method according to claim 1 wherein step (b) further comprises moistening the material to a moisture content of 5% to 20% by weight.

7. A method according to claim 1 wherein step (b) further comprises moistening the material to a moisture content greater than 10% and no greater than 15% by weight.

8. A method according to claim 1 wherein one of said support rollers is heated.

9. A method according to claim 8 wherein said first support roller is heated and said second support roller is cooled.

10. A method according to claim 8 wherein said one of the support rollers is heated to a temperature of 80° C. to 160° C.

11. A method according to claim 8 wherein said one of the support rollers is heated to a temperature of 100° C. to 120° C.

12. A method according to claim 1 wherein the flexure of the material about the first turning roller concludes and the flexure about the first support roller commences substantially in a line disposed in an imaginary plane located by the axes of the first rollers.

13. A method according to claim 1 wherein the flexure of the material about the second turning roller concludes and the flexure about the second support roller commences substantially in a line disposed in an imaginary plane located by the axes of the first rollers.

14. A method according to claim 1 comprising the additional step of moistening one of said shrinkage belts.

15. A method according to claim 1 comprising the additional step of drying one of said shrinkage belts.

16. A method according to claim 1 whereby a circumferential speed of one of said first and second support rolls is no greater than a speed of the inelastic layer of an associated one of said first and second shrinking belts as said associated one of said shrinking belts passes over said one of said support rolls.

17. An apparatus for continuously moistening, smoothing and compressively shrinking tubular textile material comprising:

(a) a fabric spreader for stretching the material along its width;

(b) a moistening unit for receiving the material from the fabric spreader;

(c) a first smoothing and shrinking unit including:

(i) a first shrinkage belt having an elastic layer and an inelastic layer, (ii) a first turning roll engaging the inelastic layer of the first shrinkage belt over a portion of a circumference of the first turning roll for receiving and engaging a first side of the material from the moistening unit with the elastic layer of the first turning belt, and (iii) a first support roll for receiving the material in engagement with the elastic layer of the first shrinkage belt from the first turning roll and supporting the material and the first shrinkage belt over a portion of a circumference of the first supporting roll; and (d) a second smoothing and shrinking unit including:

(i) a second shrinkage belt having an elastic layer and an inelastic layer, (ii) a second turning roll engaging the inelastic layer of the second shrinkage belt over a portion of a circumference of the second turning roll for receiving and engaging a second side of the material from the moistening unit with the elastic layer of the second turning belt, and (iii) a second support roll for receiving the material in engagement with the elastic layer of the second shrinkage belt from the first turning roll and supporting the material and the second shrinkage belt over a portion of a circumference of the second supporting roll.

18. An apparatus according to claim 17 wherein the elastic layer in each of said shrinkage belts comprises felt.

19. An apparatus according to claim 17 wherein the elastic layer in each of said shrinkage belts comprises gauze.

20. An apparatus according to claim 17 wherein each of said shrinkage belts is 8 mm to 16 mm thick.

21. An apparatus according to claim 17 wherein each of said shrinkage belts is 12 mm to 16 mm thick.

22. An apparatus according to claim 17 including a nip roll cooperating with one of said first and second turning rolls to define a nip in which the material engages an associated one of said first and second shrinkage belts.

23. An apparatus according to claim 17 in which the first supporting roll is heated and the second supporting roll is cooled.

24. An apparatus according to claim 17 in which one of said first and second shrinkage belts is water permeable.

25. An apparatus according to claim 17 whereby a circumferential speed of one of said first and second support rolls is no greater than a speed of the inelastic layer of an associated one of said first and second shrinking belts as said associated one of said shrinking belts passes over said one of said support rolls.

26. An apparatus according to claim 17 wherein the flexure of the material about one of said first and second turning rolls concludes and the flexure about an associated one of said first and second support rolls commences substantially in a line disposed in an imaginary plane located by the axis of said one of said turning rolls and the axis of said one of said support rolls.

27. An apparatus according to claim 17 including a belt moistening unit for controlling the moisture of one of said first and second shrinkage belts.

28. An apparatus according to claim 17 including a belt dryer for controlling the moisture of one of said first and second shrinkage belts.

* * * * *

US004908918B1

REEXAMINATION CERTIFICATE (3875th)

United States Patent [19] [11] B1 4,908,918

Strahm et al. [45] Certificate Issued Sep. 14, 1999

[54] METHOD AND APPARATUS FOR COMPRESSIVE SHRINKAGE OF TUBULAR FABRIC

[75] Inventors: Christian Strahm, Bronschhofen; Paul Suess, Bettwiesen, both of Switzerland

[73] Assignee: Santex AG, Tobel, Switzerland

Reexamination Request:
No. 90/004,805, Oct. 17, 1997

Reexamination Certificate for:

| | |
|---|---|
| Patent No.: | **4,908,918** |
| Issued: | **Mar. 20, 1990** |
| Appl. No.: | **07/207,760** |
| Filed: | **Jun. 16, 1988** |

[30] Foreign Application Priority Data

Jun. 16, 1987 [EP] European Pat. Off. ..... 87810343

[51] Int. Cl.[6] ..... D06C 2/00
[52] U.S. Cl. ..... 26/18.6
[58] Field of Search ..... 26/18.6, 80, 81, 26/18.5

[56] References Cited

U.S. PATENT DOCUMENTS 3,316,610 5/1967 Manock .

FOREIGN PATENT DOCUMENTS

| | | |
|---|---|---|
| 986760 | 8/1951 | France . |
| 644905 | 5/1937 | Germany . |
| 715135 | 12/1941 | Germany . |
| 716515 | 12/1941 | Germany . |
| 909338 | 4/1954 | Germany . |
| 2438143 | 3/1975 | Germany . |
| 2616423 | 2/1977 | Germany . |
| 1710592 | 3/1980 | Germany . |
| 372803 | 5/1932 | United Kingdom . |

OTHER PUBLICATIONS

Article—Appretur der Textilien—Mechanische und Chemische Technologie der Ausrustrung, Textil–Ing Walter Bernard (1960) pp. 172–177 (translation enclosed).
Monforts brochure—Controlled Shrinkage (undated).
Arbach brochure IDA2—Press–und Friktions–Kalander; 1 page (translation provided).
Article—Ausbildungsmittel Unterrichtshilfen—Textilveredlung Appretieren pp. 105–107 (1983) (translation provided).
Article—Das Kompressive Krumpfen von Geweben Und Maschenware Textilveredlung 24 (1989), Nr. 6, pp. 228–234 (translation provided).
Article—Kontrolliertes Kompressives Krumpfen von Geweben und Gewirken—Melliand Textilberichte, Jul. 1987, pp. 503–506 (translation included).
Article—Wieweit Sind Die Klassichen Schrumpfarm–Ausrustungsverfahren Auf Maschenwared Ubertragbar? Wirkerel–und Strickerel–Technik 29 (1979( 11, pp. 759–760, 762 (translation included).
Article—Appreturkunde Wirk–und Strickwaren—Erich Meyer (1951), pp. 38–39, 52–54 (*summary translation included).

*Primary Examiner*—A. Vanatta

[57] ABSTRACT

A method and apparatus for smoothing and shrinking tubular fabric material. The method comprises stretching the material along its width and moistening the stretched material. The material then enters a first smoothing and shrinking unit and is turned around a turning roller. The material engages a shrinkage belt which presses one side of the material against a support roller. The material then exits the first smoothing and shrinking unit and enters a second where the other side of the material is treated. The shrinkage of the material is increased since an elastic layer on each shrinkage belt varies the surface tension engaged to each side of the material.

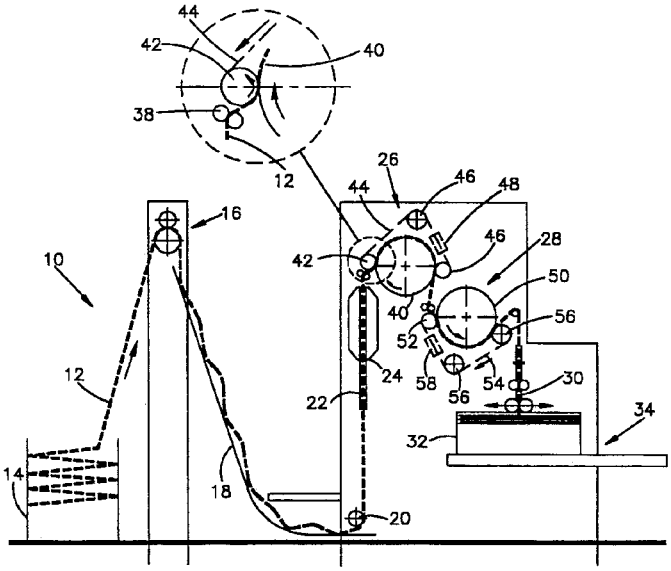

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 17–28 is confirmed.

Claim 1 is determined to be patentable as amended.

Claims 2–16, dependent on an amended claim, are determined to be patentable.

1. A method for continuously moistening, smoothing and compressively shrinking tubular textile material comprising the steps of:

(a) stretching the material along its width;

(b) moistening the stretched material;

(c) turning a first shrinking belt having an elastic layer and an inelastic layer around a first turning roll so that the elastic side of the first shrinking belt faces radially outwardly away from a center of the first turning roll;

(d) engaging a first side of said material with the elastic layer of the first shrinking belt on the first turning roll;

(e) passing the material engaged with the elastic layer of the first shrinking belt over a first support roll;

(f) turning a second shrinking belt having an elastic layer and an inelastic layer around a second turning roll so that the elastic side of the second shrinking belt faces radially outwardly away from a center of the second turning roll;

(g) engaging a second side of said material with the elastic layer of the second shrinking belt on the second turning roll; and (h) passing the material engaged with the elastic layer of the [first] *second* shrinking belt over a [first] *second* support roll.

* * * * *